US006609966B1

(12) United States Patent
Kurosawa et al.

(10) Patent No.: US 6,609,966 B1
(45) Date of Patent: Aug. 26, 2003

(54) COIN HOPPER DEVICE

(75) Inventors: Motoharu Kurosawa, Iwatsuki (JP); Hiroshi Abe, Iwatsuki (JP)

(73) Assignee: Asahi Seiko Co., Ltd. (JP)

( * ) Notice: Subject to any disclaimer, the term of this patent is extended or adjusted under 35 U.S.C. 154(b) by 146 days.

(21) Appl. No.: 09/636,416

(22) Filed: Aug. 10, 2000

Related U.S. Application Data

(62) Division of application No. 09/405,760, filed on Sep. 27, 1999.

(30) Foreign Application Priority Data

Oct. 20, 1998 (JP) ..... 10-333332
Nov. 17, 1998 (JP) ..... 10-368438

(51) Int. Cl.[7] ..... G07D 1/00
(52) U.S. Cl. ..... 453/57; 453/49
(58) Field of Search ..... 453/49, 57

(56) References Cited

U.S. PATENT DOCUMENTS 1,433,943 A * 10/1922 Doldt ..... 453/57
3,680,566 A * 8/1972 Tanaka et al. ..... 194/219
3,746,211 A * 7/1973 Burgess, Jr. ..... 221/13
4,172,462 A * 10/1979 Uchida et al. ..... 453/6
4,342,384 A * 8/1982 Fukase et al. ..... 198/367
4,347,924 A * 9/1982 Hayashi et al. ..... 194/346
4,396,029 A * 8/1983 Anderson ..... 453/15
4,620,559 A * 11/1986 Childers et al. ..... 194/346
4,635,661 A * 1/1987 Uematsu et al. ..... 194/217
4,752,274 A 6/1988 Abe
4,836,825 A * 6/1989 Smeets et al. ..... 453/49
5,056,643 A * 10/1991 Kirberg ..... 194/202
5,100,367 A * 3/1992 Abe ..... 198/659
5,141,443 A * 8/1992 Rasmussen et al. ..... 453/10
5,462,480 A * 10/1995 Suzukawa ..... 453/49
5,468,181 A * 11/1995 Ishida et al. ..... 453/17
5,542,880 A * 8/1996 Geib et al. ..... 194/346
5,562,536 A * 10/1996 Uchida et al. ..... 453/12
5,607,351 A * 3/1997 Schwartz ..... 453/32
5,688,166 A * 11/1997 Chen ..... 453/49
5,810,654 A * 9/1998 Suzuki et al. ..... 198/587
5,911,622 A * 6/1999 Kinoshita et al. ..... 453/11
5,964,657 A * 10/1999 Abe et al. ..... 453/3
5,997,396 A * 12/1999 Itako ..... 453/17

(List continued on next page.)

FOREIGN PATENT DOCUMENTS

EP 0 831 431 3/1998
JP 55-140984 11/1980

OTHER PUBLICATIONS

Orton et al, US 2001/0021633 A1, Sep. 13, 2001.*

*Primary Examiner*—Donald P. Walsh
*Assistant Examiner*—Jeffery A Shapiro
(74) *Attorney, Agent, or Firm*—McGlew and Tuttle, P.C.

(57) ABSTRACT

A miniaturized coin hopper device is provided so as to have a lower height. The device has an electric motor which is arranged such that the projection end of a rotated axis thereof is located at a lower side. A first gear is fixed on this projection end of rotated axis. A disk for discharging coins one by one is provided at the bottom of a hopper which stores the coins. A second gear rotates this disk. A gear train connects this second gear and the first gear. The problem of a true coin being disbursed when a pseudo-coin was in a hopper device and the return button was pushed is also addressed. A distinguishing element checks the money kind of a deposited coin. A reserve temporarily holds the coin distinguished by this distinction element. A storage for coins of same money kind and a disbursing element is provided for the the coin in this storage to return the coin reserved in the temporary reservation. A device is also provided to distribute the coin reserved in said temporary reservation to the storage.

13 Claims, 9 Drawing Sheets

U.S. PATENT DOCUMENTS 6,003,652 A * 12/1999 Murata et al. ..... 194/206
6,021,883 A * 2/2000 Casanova et al. ..... 194/217
6,029,794 A * 2/2000 Tamaki ..... 194/338
6,030,284 A * 2/2000 Frank ..... 198/836.2
6,039,165 A * 3/2000 Wild ..... 194/217
6,039,166 A * 3/2000 Abe et al. ..... 194/317
6,042,470 A * 3/2000 Geib et al. ..... 453/10
6,080,056 A * 6/2000 Karlsson ..... 453/3
6,095,916 A * 8/2000 Tamaki ..... 198/624
6,193,598 B1 * 2/2001 Tsuchida ..... 221/241
6,193,599 B1 * 2/2001 Kurosawa et al. ..... 453/57
6,196,371 B1 * 3/2001 Martin et al. ..... 194/317
6,200,213 B1 * 3/2001 Cole ..... 453/18
6,210,264 B1 * 4/2001 Richardson ..... 453/57
6,328,646 B1 * 12/2001 Abe et al. ..... 198/550.01

* cited by examiner

COIN HOPPER DEVICE

This is a division of application Ser. No. 09/405,760 filed Sep. 29, 1999,

FIELD OF THE INVENTION

This invention relates to a coin processor to process plural kinds of loose coins of various money types. Especially, this invention concerns a coin processor which is built in a vending machine and processes the coin thrown therein into an exchange coin. This invention also concerns a coin processor to prepare exchange money, by processing plural types of coins thrown into the vending machine, of the money type. The term "coin" in this specification includes currency. The term "coin" can also refer to pseudo-coins such as medals, tokens and so on. Further, the tern "vending machine" in this specification of course includes the medal or token vending machine. Also, the term "vending machine" refers to devices for the em change of coins or currency including machines of the game machine type.

BACKGROUND OF THE INVENTION

A comparatively small coin hopper device is disclosed in Japanese Patent Application 10-254512 by this applicant.

FIG. 9 is an outlined perspective view of the coin hopper device with an escalator disclosed in Japanese Patent Application 10-254512. This hopper device H stores a lot of coins (not shown in the figure) in hopper tank T, of a fennel shape and discharges the coins above one by one. Electric motor device E with gear train is installed under base board B diagonally arranged Disk D at the bottom in hopper tank T is rotated with the electric motor device E. A penetration hole (not shown) of this disk D is rotated, the coin is pushed out along base board B and is then discharged out from hopper tank T. The coin pushed out from hopper device H is transported above with an escalator device. The escalator device has a passage P for coins providing communications to the base plate B. Frame P is provided for reinforcing the long escalator.

This hopper device H, electric motor device E with the gear train was set up under base board B, and hopper tank T was set up on base board B. Therefore, hopper device H had a problem which enlarged in the vertical direction as shown in FIG. 4. To miniaturize the hopper device, for instance, the base board B is made horizontal, and the electric motor device E and the gear train are sideways arranged under the base board B. However, there was a limit in the miniaturization of coin hopper device with the above-mentioned arrangement.

When vending machines are used and the amount of money deposited in the machine is more than the price of commodity, the difference is automatically disbursed as change (exchange money). In addition, when the coin inserted into vending machine is a pseudo coin such as foreign country coin and so on, this coin is automatically returned or canceled. The coin inserted into the vending machine is recycled for exchange money by the coin processor built therein. Coins for exchange money are prepared beforehand in the vending machine and when the exchange coins are insufficient, the coin inserted is reused for exchange money.

A coin processor for a vending machine is discussed in Japanese Patent Application 8-214917 or Patent Disclosure 9-265561 by this applicant. As for this coin processor, a plurality of hopper devices to store a lot of coins of same money kind in lose state are vertically piled up. And, on the top part of hopper devices vertically piled up, a coin selector is provided. As for the coin inserted into the vending machine, the money kind is distinguished with the selector, and then existing the passage, the coin is stored in the hopper device of same money kind. When the exchange coin is necessary, each hopper device is operated by an electric signal and the desired exchange coin is disbursed automatically.

In the coin processor for above-mentioned prior vending machine, there was a problem that a pseudo-coin which is similar to the actual coin is not rejected with the selector and is stored in the hopper device. That is, there was a problem that another true coin was disbursed from the hopper device, when a pseudo-coin was stored in the hopper device and the return button was pushed. The coin processor for prior vending machine exchanged a pseudo-coin for a true coin. On the other hand, there was another problem that a true coin was rejected when the accuracy of coin selector was raised.

SUMMARY AND OBJECTS OF THE INVENTION

It is an object of the invention to provide a miniaturized coin hopper device. Especially, this invention is developed from a purpose to lower the height of coin hopper device as much as possible.

According to the invention a coin hopper device is provided with at least an electric motor mechanism which is arranged such that the projection end of a rotated axis thereof is located at a lower side. A first gear mechanism is fixed on this projection end of the rotated axis. A disk mechanism is provided for discharging coins one by one. The disk mechanism is provided at the bottom of a hopper which stores the coins. A second gear mechanism is provided for rotating the disk. A gear train mechanism connects this second gear mechanism and the first gear mechanism.

According to another aspect of the invention is a coin hopper device is provided with a first gear mechanism and a second gear mechanism and also a gear mechanism.flatly arranged at a lower position than a disk mechanism. The electric motor may be arranged at the side of the disk mechanism.

It is another object of the invention to provide a device in which when the inserted coin is temporarily reserved and the return button is pushed, the inserted coin is returned. That is, this invention adds the escrow function to the coin processor for vending machine and avoids the problem of exchanging a pseudo-coin for a true coin.

It is still another object of the invention that when the inserted coin is temporarily reserved and the commodity purchase button is pushed, the coin is accepted within the vending machine.

According to another aspect of the invention, a coin processor is provided with at least a mechanism to distinguish the money kinds thrown-into (deposited) the device. A mechanism is provided to reserve temporarily the coin distinguished by this distinguishing mechanism. A storage facility for coins of same money kind and a mechanism to disburse the coin in the storage facility are also provided. A mechanism to return the coin reserved in the temporary reservation mechanism and a mechanism to distribute coins reserved in the temporary reservation mechanism to the storage facility are provided, The coin processor of the invention may have a storage facility of coin of same money kind and the disbursement mechanism of the coins are piled as one body.

The storage facility of same money kind coin and the disbursement mechanism of the coin which are united are piled as a plurality and vertically.

The coin processor of the invention may have the temporary reservation mechanism of coin and the storage facility of same money coin kind in the form of hopper devices respectively.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
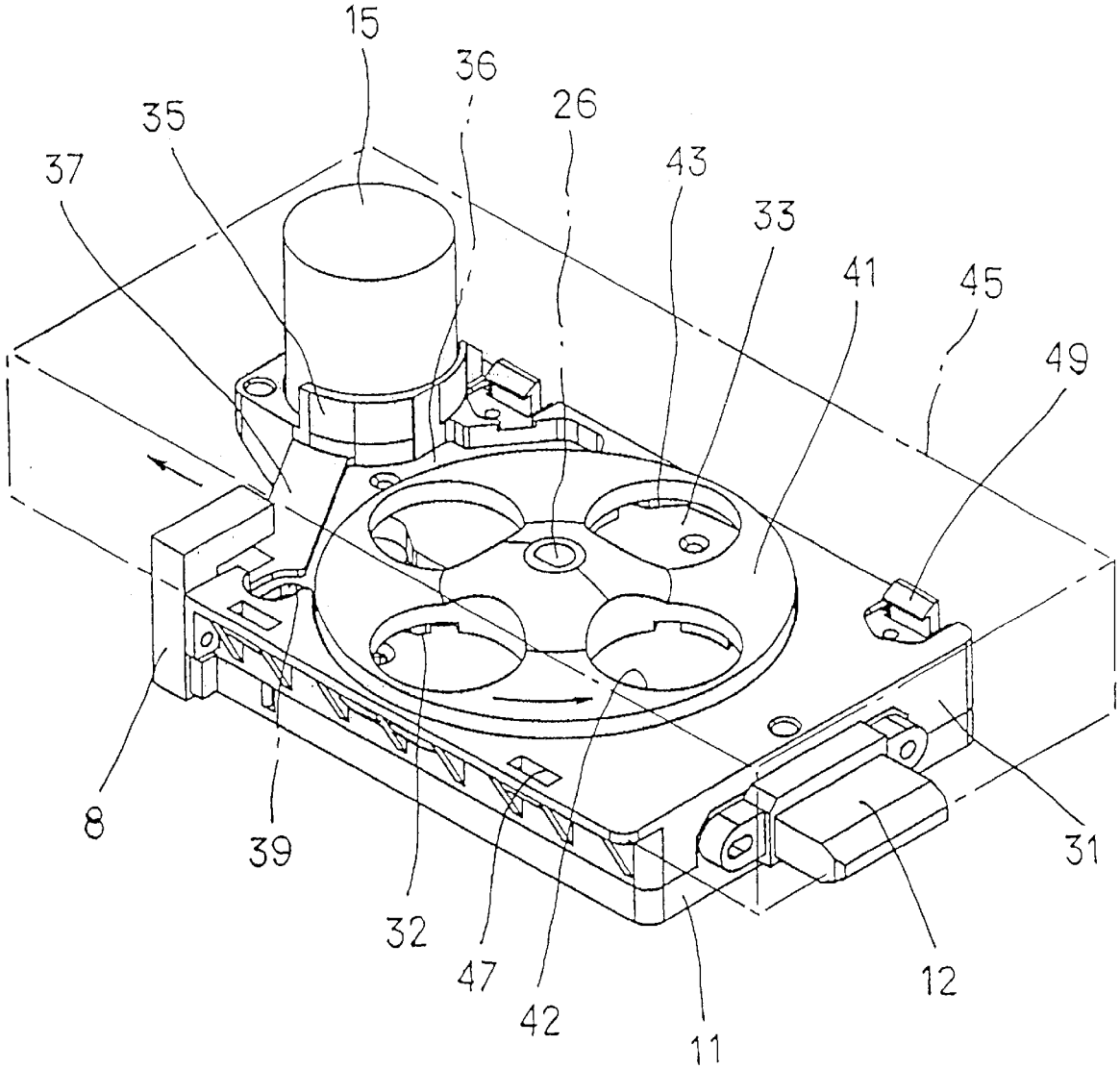
FIG. 1 is an outlined perspective view in which an embodiment according to this invention is shown.
Figure 2:
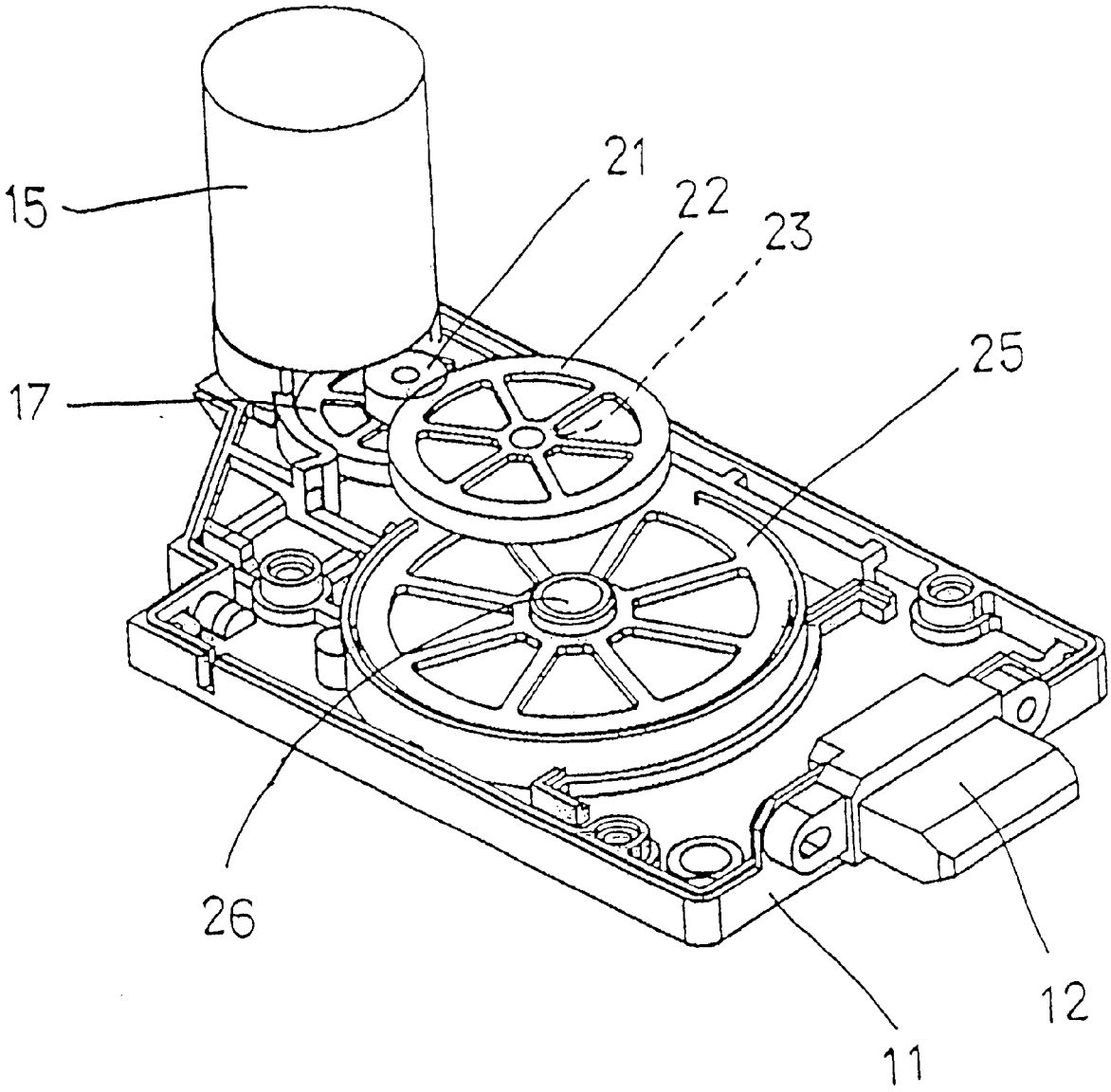
FIG. 2 shows an outlined perspective view in which the upper part of FIG. 1 is removed.
Figure 3:
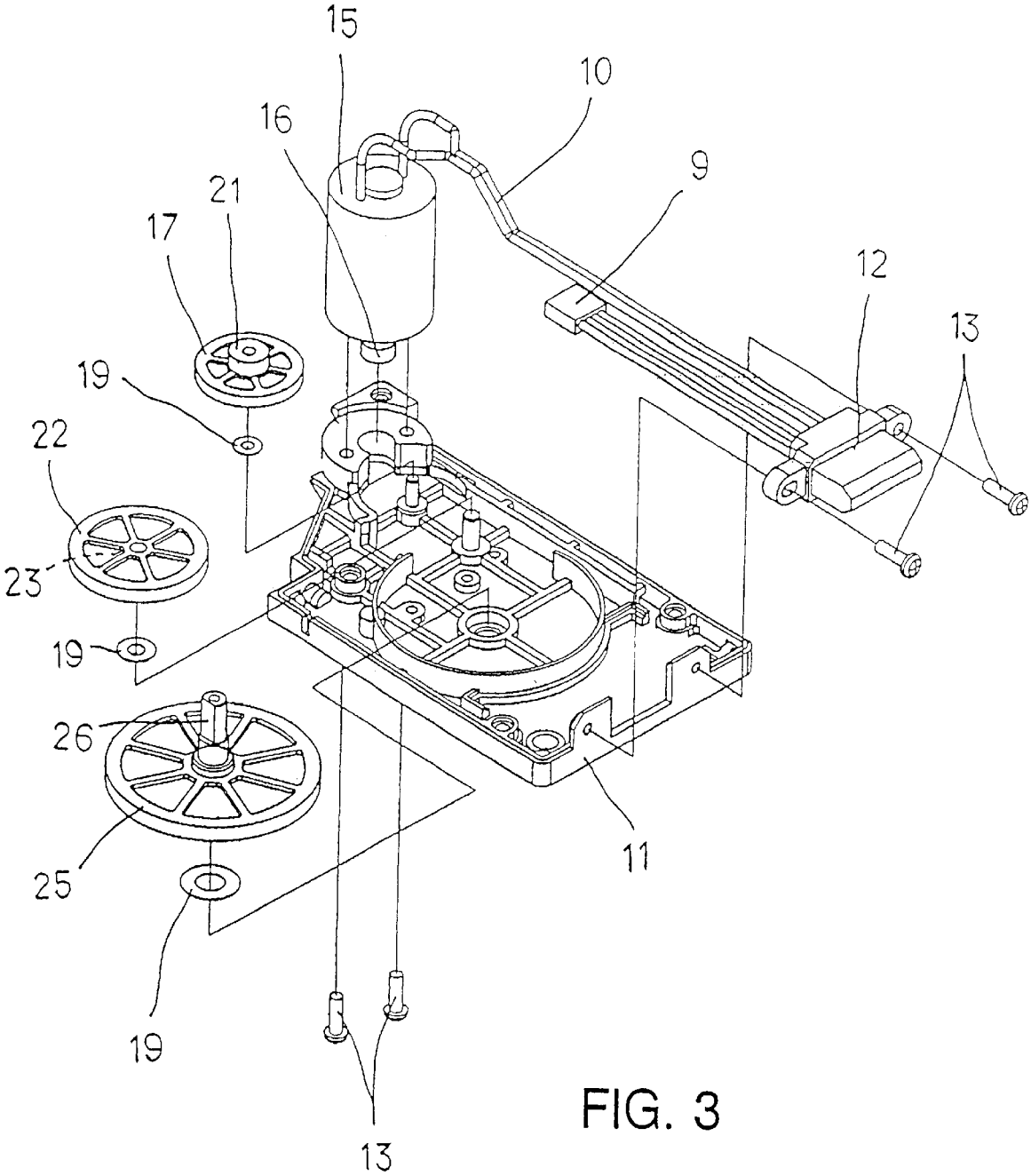
FIG. 3 is a perspective view showing the elements shown in FIG. 2 in a disassembled state.

Referring to the drawings in particular, an example of the invention is shown in FIGS. 1–3. The device of the invention includes an almost rectangular bottom board 11. This bottom board 11 with this complex shape is a resin molded product. Electric connector 12 is fixed on one end part of rectangular bottom board 11 by means of screws 13. On the other end part of bottom board 11, electric motor 15 is extends up and is fixed with screws 13. Electric motor 15 with column shape is fixed in a head standing condition. A small gear 16 is fitted on the projected turning shaft which is located under electric motor 15. A gear 17 at the above left in FIG. 3 is rotatably mounted on the pivot standing up on bottom board 11, adjacent to slider 19. Middle gear 17 engages with small gear 16. Moreover, small gear 21 is integrally formed on the upper surface of middle gear 17. Gear 22 at the left center in FIG. 3 is also rotatably mounted on the pivot which extends up from bottom board 11, adjacent to slider 19. Middle gear 22 engages with small gear 21 (see FIG. 2). Small gear 23 is integrally formed under middle gear 22. Large gear 25 at the lower left in FIG. 3 has a central part penetrated through by rotation axis 26 at the center thereof The lower part of this rotation axis 26 is rotatably inserted into bottom board 11, adjacent to slider 19. Large gear 25 engages with small gear 23 (see to FIG. 2).

At the above center in FIG. 3 wiring 10 for the electric motor 15 is shown. FIG. 3 also shows an electric connector 9 for a sensor.

FIG. 2 shows the assembled state of the device of the embodiment of FIGS. 1–3. FIG. 1 shows the further almost rectangular base board 31 on the assembled state of the device of FIG. 2. This further shows the arranged round disk 41 thereon.

The base board 31 consists of a resin molded product. Large metallic plate 33, which almost becomes a circle, is fixed on the center thereof On the point part of base board 31, ring 35 which freely penetrates through electric motor 15 is formed. Details are omitted from the drawing, but between disk 41 and ring 35, guide splinter 36 for coins is fixed on plate 33. Moreover, exit 37 for coins is formed near ring 35 of base board 31. Some details were omitted, but at each side of coin exit 37, rollers 39 are pivoted respectively. A showing of the other rollers has been omitted. Each roller 39 is moveably mounted respectively with a spring (not shown).

Also, near one of rollers 39, a couple of pins 32 for guiding coins are provided to rise and fall freely with a spring board (not shown). As for the other pins, these have not been shown to preserve clarity in the drawing.

Disk 41 has a circle shape. Penetration holes 42 for holding coins flat are opened in the direction of surrounding and at equal intervals. Two or more small long and slender nails 43 are provided to push the coin out. These nails 43 project under the disk 41. As shown in FIG. 1, big hopper 45 for coin storage having a flat rectangular funnel shape is further installed thereon. Hopper 45 shows only the size in chain lines, but it is a resin molded product. A corner part of hopper 45 is formed to store the upper part of electric motor 15. Moreover, the hooks (not shown) formed on the under edge of hopper 45 are inserted into small holes 47 on base board 31. A couple of nails 49 formed on base board 31 dig into hollows (not shown) formed on hopper 45, existing spings (not shown), and the hopper 45 is fixed thereon. Further, near coin exit 37, sensor 8 for coin calculation which has a F shape is installed.

As for this execution example with the above mentioned configuration, when electric motor 15 is turned, small gear 16 is rotated. When small gear 16 is rotated, middle gear 17 and small gear 21 are rotated. When small gear 21 is rotated, middle gear 22 and small gear 23 are rotated (refer to FIG. 2). When small gear 23 is rotated, large gear 25 is rotated (see FIG. 2). When large gear 25 is rotated, disk 41 is rotated in the direction of the arrow, existing rotation axis 26 (see FIG. 1).

As a result of the rotation of disk 41, a plurality of coins in flat rectangular fennel-shaped hopper 45 will be one by one disbursed to exit 37 by means of disk 41. When electric motor 15 is trued, the coins fall into either of penetration holes 42 of rotated disk 41. The lowest coins which fall in penetration holes 42 slide on the upper surface of metal p ate 33, by rotation of disk 41 and existing nails 43 The coin which slides on the upper surface of plate 33 with nail 43 is guided toward the exit 37, existing inner wall of hopper 45 and guide splinter 36. The coin guided toward the exit is pushed out from the position of penetration hole 42 to the outside, by means of nail 43 and a couple of pins 32. The coin pushed out is further pushed outside by nail 43, resisting the springs of a couple of rollers 39 (refer to arrows of FIG. 1).

According to this invention as described above, only by changing the arrangement of composition, a big effect is achieved that the coin hopper device can be miniaturized. That is, according to this invention, there is a big effect in which the height of hopper device can be greatly lowered, by arranging an electric motor in an upright condition and arranging a gear train for deceleration flatly and horizontally.

Figure 4:
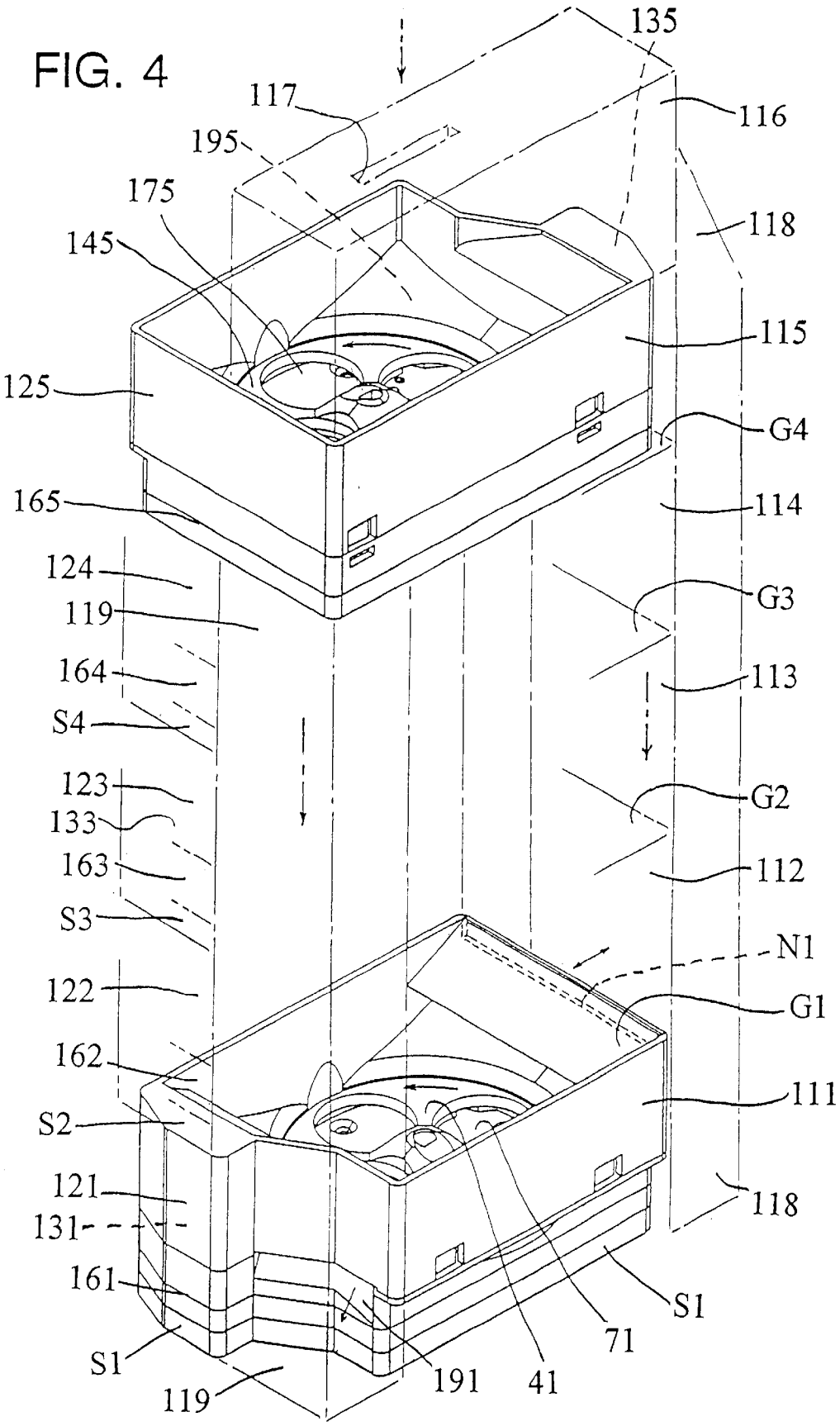
FIG. 4 is a perspective view in which the whole of another embodiment according to this invention is shown in the outline.

The device of FIG. 4 has a first hopper device 111 at lower side thereof, which has an almost horizontal box shape. And, a similar second hopper device 112 is arranged thereon. On the second hopper device 112, a similar third hopper device 113 is arranged. A similar fourth hopper device 114 is arranged on the third hopper device 113. In addition, on this fourth hopper device 114, there is arranged a similar flat-box-shaped hopper device 115. And, on the hopper device 115, there is arranged a coin selector 116 which has a upright box shape.

The selector 116 distinguishes electronically the coin which was inserted into vending machine (not shown in the drawing). That is, the coin thrown into or deposited in the sending machine is guided by using natural fall and thrown in a slot 117 of selector 116. The coin which is thrown in slot 117 and falls naturally is distinguished electronically. As for the coin which falls naturally, the diameter, the thickness, and the material are distinguished for instance with three pairs of magnetic sensors (not shown) and the money kind or type thereof is determined.

The coin, of which the money kind is determined, is guided with the solenoid (not shown) etc., falls naturally in hopper 125 of hopper device 115, and is stored. The pseudo coin such as a foreign coin of which the money kind is not determined is rejected or returned, using natural fall and being guided by passage 118.

Figure 5:
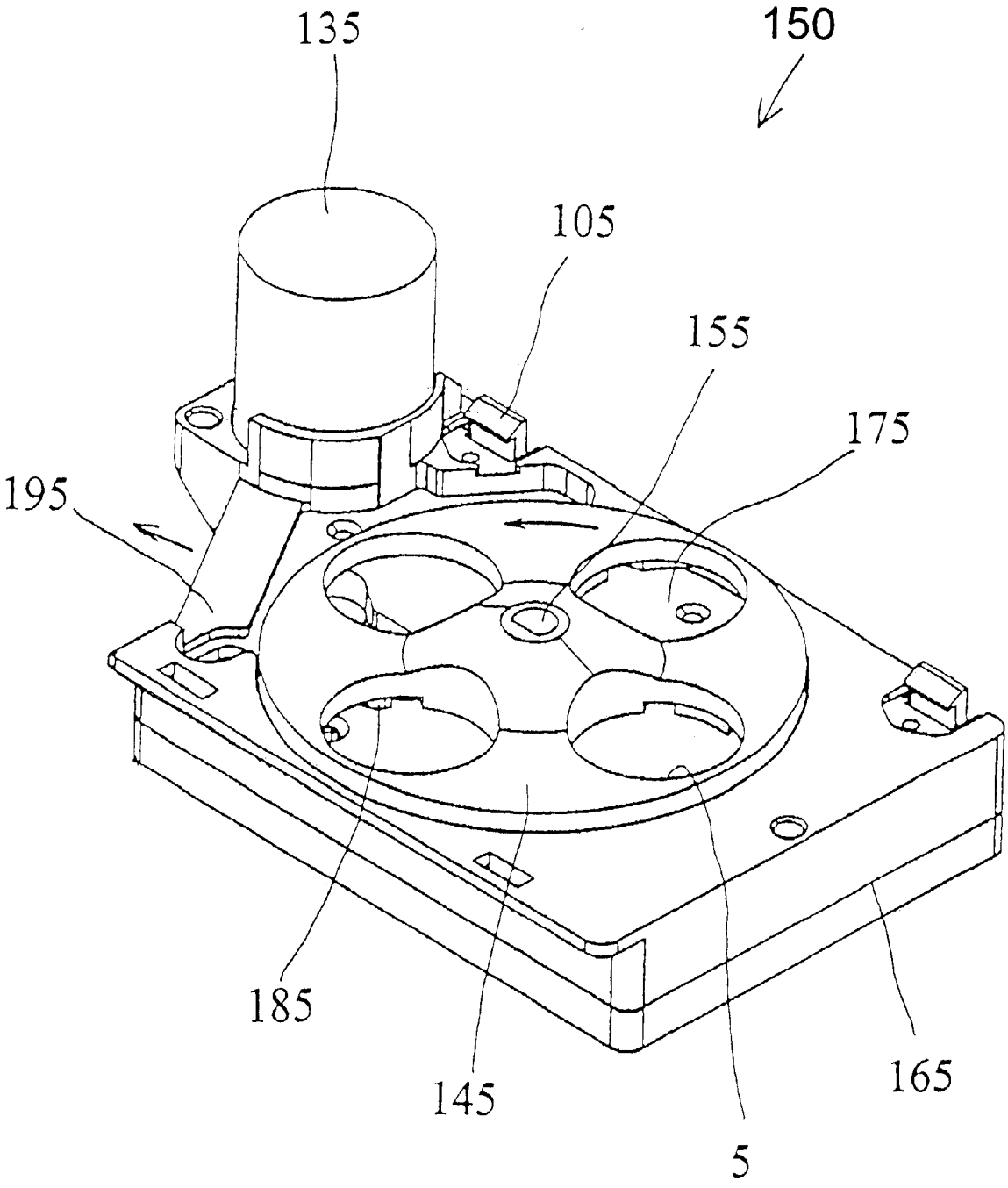
FIG. 5 is a perspective view which expands and shows some necessary parts of the embodiment of FIG. 4.

In FIG. 5, there is shown the hopper device 115, of which hopper 125 with rectangular tube shape is removed. Hopper device 115 has an electric motor 135, of which the projection end of turning shaft (not shown) is located downward. On the lower end of turning shaft of electric motor 135, a first gear (not shown) is fixed. On the other hand, at the bottom position of hopper 125 in which coins are stored, a disk 145 is provided (see FIG. 5). This round disk 145 discharges coins one by one. On the lower end of rotation axis 155 of disk 145, a second gear (not shown) is fixed. There is provided a gear train (not shown) for connecting the second gear and the first gear (see embodiment of FIGS. 1–3). The first gear, the second gear and the gear train are located within a case 165 for flat driving device. This case 165 is constituted by a rectangular bottom board and a base board which becomes a lid. Moreover, the case 165 is a resin molded product and, at the center of upper surface thereof a metallic big plate 175 with almost circular shape is fixed. Between disk 145 and electric motor 135, a coin guide splinter (not shown) is fixed. Moreover, at the coin discharge entrance near the electric motor 135, a sensor 195 for coin detection is arranged. Sensor 195 includes a magnetic sensor for instance and detects the money kind of the coin by the diameter etc. of the discharged coin. On both sides of sensor 195, a roller (not shown) is pivoted, respectively. Each roller is freely moved with a spring (not shown), respectively Near the one roller, a couple of pins for coin guide (not show) are provided to rise and fall in fee, existing spring board. Further, in the disk 145, a penetration holes 5 for holding coins in a flat state are opened in surrounding direction and at equal intervals. At the under surface of disk 145, a plurality of small slender nails or pins (protruding elements) 185 project for pushing coins.

Hopper 125 is a resin molded product and one corner part thereof is formed to store the upper side part of electric motor 135 This hopper 125 is fixed on case 165, for instance, nails or retention latches 105 being formed on case 165 and inserted into holes with a sparing (not shown). When the electric motor 135 turns, as for hopper device 115, disk 145 rotate s in the arrow direction, with rotation of the gear train and rotation axis 155. As a result, different money kinds of coins in hopper 125 will be disbursed one by one from discharge entrance near electric motor 135, by disk 145. When electric motor 135 is turns, the coin falls into either of penetration holes 5 of rotated disk 145. The lowest coin falls into penetration holes 5 and slides on the upper surface of metal plate 175, by rotation of disk 145 and existing nails 185. The coin which slides on the upper surface of plate 175 is guided in the direction of sensor 195, positioned along the inner wall of hopper 125 and by the guide splinter (not shown), The coin which was guided toward the sensor position 195 is pushed out, outside from the position of penetration hole 5, by nail 185 and a couple of pins (not shown), The coin pushed out, outside, is further pushed out on sensor 195 and discharged, by nail 18S and resisting the spring of couple rollers (not shown). When the pushed out and discharged coin passes sensor 195, the money kind thereof is judged electronically.

Figure 6:
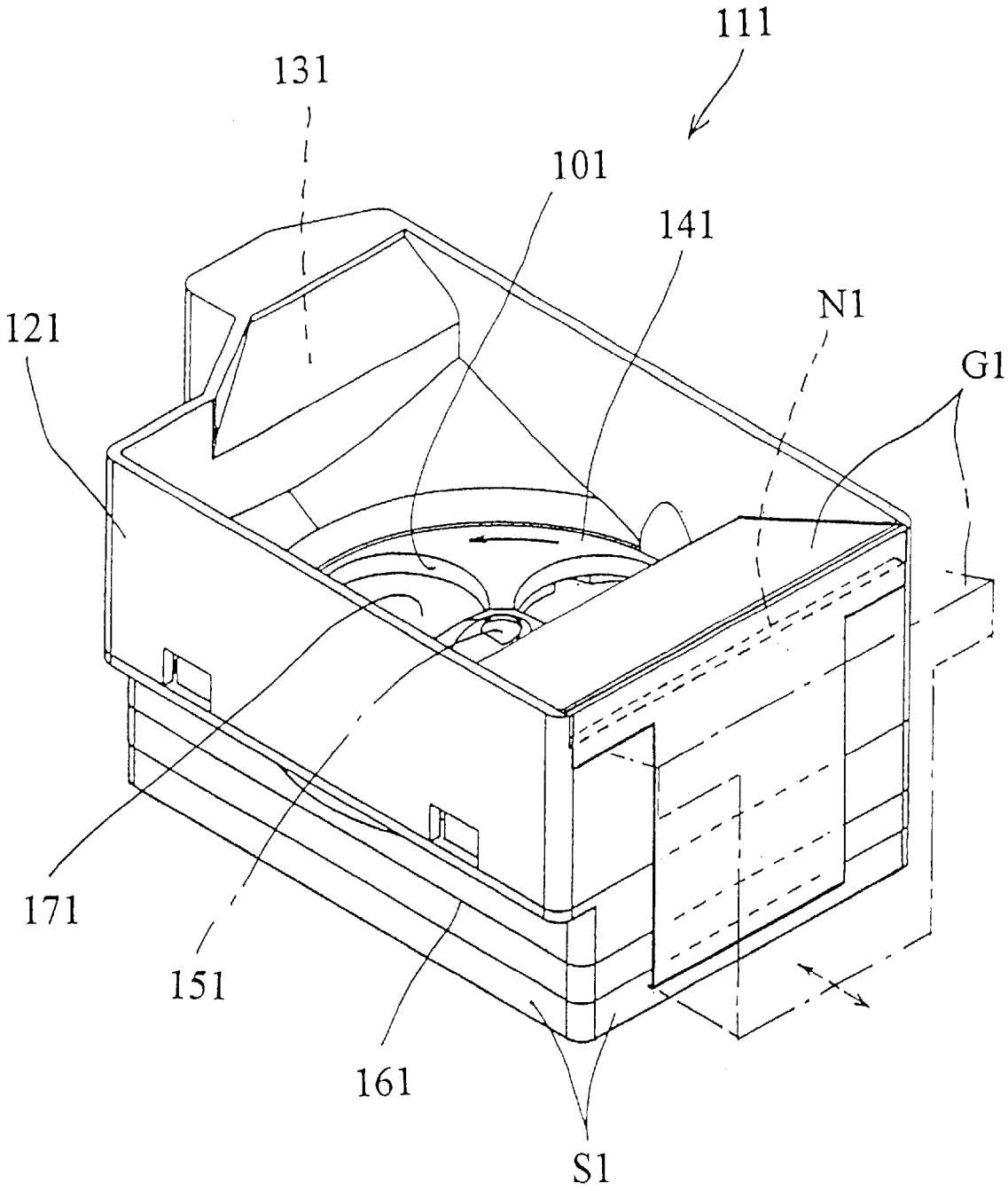
FIG. 6 is a perspective view which expands and shows other necessary parts of the embodiment of FIG. 4.

FIG. 6, the most lowest hopper device 111 shown in FIG. 1 is shown The hopper device 111 is similar to hopper device 115 of FIG. 2. That is, disk 141 which discharges coins one by one, is set at the bottom position of hopper 121 for storing coins. Similarly, at the bottom of rotation axis 151 of disk 141, a gear (not shown) is fixed (see embodiment of FIGS. 1–3). A plurality of gears (not shown) including this gear are set in flat case 161 for driving device In a similar way, case 161 is a resin molded product and, at the center of upper surface thereof, there is fixed a metallic and big plate 171 which has an almost circular configuration. Moreover, at the coin discharge entrance near electric motor 131, a sensor 191 for coin detection is arranged (see the lower part of FIG. 4).

The sensor 191 is formed of a magnetic sensor for instance and detects the discharged coin. Therefore, sensor 191 concerned is used for the calculation of the discharged coin. In the same way, on both sides of sensor 191, a roller (not shown) is pivoted respectively. Moreover with a spring (not shown), each roller can be moved freely, respectively. Similarly, near the one roller, a couple of pins (not shown) for coin guiding are provided to rise and fall in free, existing spring board. Also, in disk 141, penetration holes 101 for holding the coin flat are opened in surrounding direction and at equal intervals. In the same way, on the under surface of disk 141, a plurality of small slender nails (not shown) to push coin out project. Hopper 121 is also a resin molded product As for the above-mentioned hopper device 111, when electric motor 131 is turned, existing gear train (not shown) and rotation axis 151 and disk 141 are rotated along the arrow direction as well as the above-mentioned. As a result, the coins of same money kind in hopper 121 will be disbursed one by one from the discharge entrance near electric motor 131, by rotation of disk 141. That is, when electric motor 131 is turned, the coin falls in either of penetration holes 101 of rotated disk 141. The lowest coin which has fallen in penetration hole 101 slides on the upper surface of metal plate 171, by the rotation of disk 141 and the nail. The coin which slides on upper surface of plate 171 is guided toward the sensor 191, along the inner wall of hopper 141 and by the guide splinter (not shown). The coin guided toward the sensor 191 is pushed out from the position of penetration hole 101, by the nail and couple of pins (not shown). The coin pushed out, outside, is further pushed out on the sensor 191 and is discharged outside, by the nail and resisting the springs of couple of rollers (not shown). The coin which is pushed out and discharged is detected in an electronic-engineering manner, when the sensor 191 is passed.

The similar second hopper device 112 is arranged on the first hopper device 111. The similar third hopper device 113 is arranged also on the second hopper device 112. The similar fourth hopper device 114 is arranged further on the third hopper device 113. Therefore, in FIG. 5, reference numerals have been described only as to the corresponding parts of these hopper device 111–114.

With the configuration mentioned with reference to FIGS. 4–6, when the coin is thrown into the vending machine (not shown), the coin is guided and is inserted in slot 117 of elector 116. The coin inserted in slot 117 is distinguished according to a type of money by the selector 116 in an electronic manner. The coin of which the money type is not distinguished is guided into passage 118 and rejected by natural falling (see FIG. 4). That is, the coin of which the money type is not distinguished is canceled and sent to the return entrance of vending machine (not shown). The coin of which the money kind or type is distinguished with selector 116 is stored in the hopper device 115 based on the operation of a solenoid (not shown). It other words, the coin of which the money kind or type is distinguished is reserved temporarily in the hopper device 115. In this situation, when the return button of vending machine (not shown) is pushed, the electric motor 135 is driven and then the coin is discharged into passage 118. That is, the coin reserved temporarily in hopper device 115 is canceled to the return entrance of vending machine.

Usually, when the coin of which the money kind is distinguished is reserved in the hopper device 115, the commodity purchase button of vending machine (not shown) is pushed. The electric motor 135 is driven at this time and the coin is discharged in passage 118. The coin discharged from the hopper device 115 passes the sensor 195 and falls naturally in the passage 118. The money kind of the coin is judged when the coin passes sensor 195 and, for instance, solenoid S1 is operated by this judgment signal. Guide board G1 projects into passage 118 when solenoid S1 is operated, and the falling coin will be taken into hopper device 111. Therefore, when the return button of vending machine is pushed, it is preferable that electric motor 135 is driven at the high speed. Moreover, when the commodity purchase button of vending machine is pushed, it is preferable that electric motor 135 is driven in the low speed. For instance, the most upper hopper device 114 is used for e.g., 500 yen coins and the below hopper device 113 is used for e.g., 100 yen coins. And, the lowest hopper device 111 is used for e.g., ten yen coins and the above hopper device 112 is used for e.g., 50 yen coin. The yen coins represent an example only and various denominations of U.S. currency may also be provided for. It is of course good that the height of hopper 124 for the 500 yen coins (the coin with the largest diameter) is enlarged to have a big capacity. Matching to this, it is of course good that the height of hopper 122 for the 50 yen coin with the smallest diameter is reduced to have a small capacity. For instance, such as the above-mentioned, it is now assumed that 500 yen coins, which are thrown into the vending machine and of which the money kind is distinguished, is reserved in hopper device 115. When the purchase Button of the 300 yen commodity of the vending machine is pushed at this time, electric motor 135 is driven and a 500 yen coin is discharged into passage 118. The 500 yen coin is discharged from the hopper device 115 passes sensor 195 and falls naturally in passage 18. When the 500 yen coin passes sensor 195, the money kind is judged and solenoid S4 is operated by the 500 yen judgment signal. Guide board G4 is projected into passage 118 when the solenoid S4 is operated and the falling 500 yen coin is taken in hopper device 114. On the other hand, the 300 yen commodity is disbursed from the vending machine by means of a signal processor such as CPU and so on, which are omitted from the drawings.

At the same time, an exchange money signal which means 500 yen minus 300 yen equals 200 yen is output to the electric motor(not shown) of the third hopper device 113. When this electric motor is driven, one 100 yen coin is discharged from the hopper device 113 into passage 119. One 100 yen coin discharged from the hopper device 113 passes the sensor (not shown) and falls naturally in passage 119. This sensor detects one 100 yen coin and transmits the detection signal to the signal processor. One 100 yen coin discharged in passage 119 falls naturally and is disbursed to the return entrance of vending machine as exchange money. On the other hand, electric motor 133 is driven further and another 100 yen coin from the hopper device 113 is discharged into passage 119. As well as the above-mentioned, the sensor detects another 100 yen coin and transmits the detection signal to the signal processor. This signal processor confirms the completion of exchange money of the 200 yen and stops the electric motor of the third hopper device 113. Therefore, two 100 yen coins total will be disbursed to the return entrance of the vending machine as exchange money Further, as not shown, it is of course that a solenoid and so on are provided at the lower side of passage 118. For instance, when either of guide boards G1–G4 is not operated, the purpose of the solenoid is to stare the coin within the vending machine, preventing the coin from being returned. Moreover, the purpose of solenoid is to store the coin in the vending machine preventing the coin from being returned, when either of the hopper devices 111–114 is nearly full, for instance.

Figure 7:
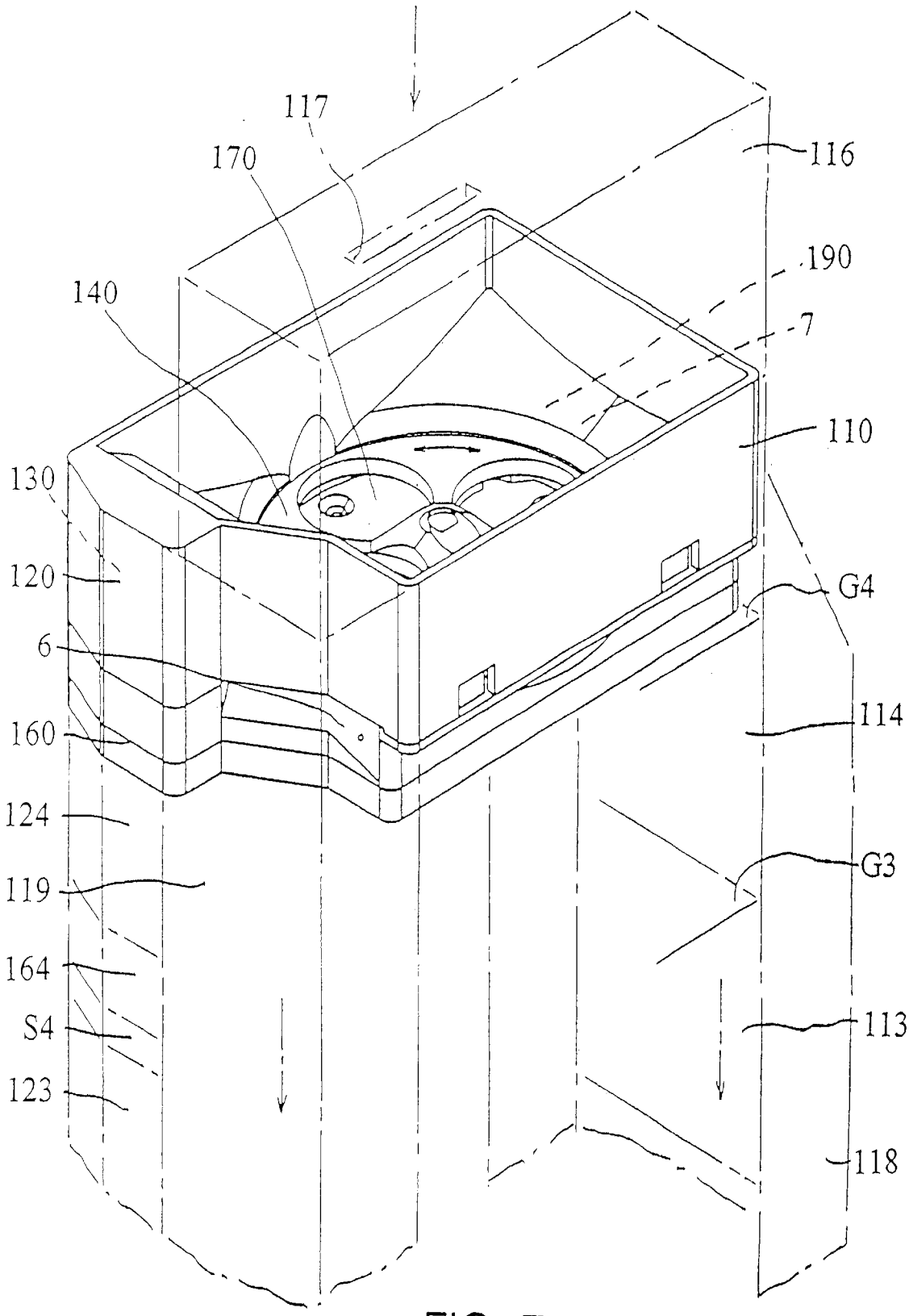
FIG. 7 is a perspective view in which the necessary parts of the third embodiment according to this invention is shown in outline.

In FIG. 7, a hopper device 110 is shown in the outline. This is still another embodiment of the invention. Hopper device 110 is formed almost similarly to hopper device 115 in FIG. 4. That is, hopper device 110 has arranged electric motor 130, which locates the projection end of turning shaft downward. Electric motor 130 provides positive and reverse rotations. A first gear (not shown) is fixed on the lower end of turning shaft of electric motor 130. Similarly, a disk 140 is prepared for at the bottom position of hopper 120 in which coins are stored. Also, with the disk 140, positive and reverse rotations are possible.

This round disk 140 discharges coins one by one. A second gear (not shown) is fixed on the lower end of the rotation axis of disk 140. A gear train (not shown) connects the second gear and the first gear. The first gear, the second gear, and the gear train are set in a flat case 160 for the driving device. This case 160 is composed of a rectangular bottom board and a base board which becomes a lid. Similarly, the case 160 is a resin molded product, and on the center of the upper surface thereof, a metallic big plate 170 which is nearly circular is fixed.

Discharge entrance 6 of coin is formed near electric motor 130 and further discharge entrance 7 for the coin is formed on the opposite side. Also, sensor 190 for coin detection is arranged at coin discharge entrance 7. This sensor 190 consists of a magnetic sensor for instance and detects the money kind of coin by the diameter etc. of discharged coin. Rollers (not shown) are pivoted at both side of each of coin discharge entrances 6 and 7 respectively. Four rollers in total are arranged respectively. Moreover, each roller thereof moves freely via a spring (not shown) respectively. Also, near each of the another rollers, a couple of pins to guide the coin (not show) are provided to freely rise and fall with a spring board, respectively. In other words, four guide pins which become two pairs in total are provided.

The disk 140 has penetration holes for holding coins flat. These holes are opened in a surrounding direction and at equal intervals. Under disk 140, two or more nails project (not shown) to push the coin out. Similarly, hopper 120 is a resin molded product and is formed to store the upper side part of electric motor 130 in the corner part thereof For instance, The nails similarly formed on case 160 cut into holes of hopper 120, existing spring (not shown), and the hopper 120 is fixed. As for above-mentioned hopper device 110, when electric motor 130 is reversely turned, existing the gear train (not shown) and rotation axis, disk 140 is rotated counterclockwise. As a result, by means of disk 140, the coins in hopper 120 will be disbursed one by one from discharge entrance 6 near electric motor 130. That is, when electric motor 130 is reversely turned, the coin falls into either of penetration holes of rotated disk 140. By further rotation of disk 140, the lowest coin which has fallen in penetration hole slides on the upper surface of metal plate 170 and the nail. The coin which slides on upper surface of plate 170 is guided toward the discharge entrance 6, along the inner wall of hopper 120 and by the guide splinter (not shown).

The coin guided toward discharge entrance 6 is pushed out from the position of penetration hole, by the nail and a couple of pins (not shown). The coin pushed out, outside, is further pushed out to discharge entrance 6 by the nail and discharged outside, resisting the spring of a couple of rollers (not shown). Similarly, when electric motor 130 is positively turned, disk 140 is rotated clockwise. As a result, the coins of various money kinds in hopper 120 will be disbursed one by one from the other discharge entrance 7 by means of disk 140. That is, when electric motor 130 is positively turned, the coins fall into either of penetration holes of rotated disk 140. The most bottom coin falls in the penetration hole and slides on the upper surface of metric plate 170, by the rotation of disk 140 and existing the nail. In the same way, the coin guided toward the discharge entrance is pushed out from the position of penetration hole, by the nail and a couple of pins (not shown). The coin pushed out is further pushed out to the discharge entrance 7 by the nail, and discharged resisting the spring of a couple of rollers (not shown). The coin which is pushed out and discharged is judged the money kind thereof electronically, when the sensor 190 is passed.

The embodiment shown in FIG. 7 has the above mentioned composition and is operated almost similar to the embodiment of FIG. 4. When the coin is thrown into the vending machine (not shown), the coin is inserted in the slot 117 of selector 116. For the coin inserted in slot 117, the money kind thereof is distinguished with the selector 116. The coin of which the money kind is not distinguished is guided in passage 119 and rejected by natural fall. That is, the coin of which the money kind is not distinguished is canceled at the return entrance of vending machine (not shown). As for the coin of which the money kind is distinguished with selector 116, it is stored in hopper device 110, properly based on the operation of solenoid not shown). In other words, the coin of which money kind is judged is reserved temporarily in hopper device 110 In this state and when the return button of vending machine (not shown) is pushed, electric motor 130 is reversely turned and the coin is discharged in passage 119. The coin reserved temporarily in hopper device 10 is canceled at the return entrance of vending machine. When the coin of which money kind is known is reserved in hopper device 110, the commodity purchase button of vending machine (not shown) is pushed. At this time, electric motor 135 is positively turned and the said coin is discharged in passage 118 The coin discharged from hopper device 110 passes sensor 190 and falls naturally in passage 118. When the coin passes sensor 190, the money kind of the coin is judged and, for instance, solenoid S1 is operated by this judgment signal. The explanation and drawing were omitted, but four hopper devices and solenoids S1–S4 are piled up under hopper device 110 as well as is shown in FIG. 1. When solenoid Si is operated, guide board G1 is projected in passage 118 and the said falling coin will be taken into hopper device 111. For instance, the most upper hopper device 114 is used for e.g., 500 yen coins as well as FIG. 4 and the hopper device 113 below is used for e.g., 100 yen coins. The lowest hopper device 11 is used for 10 yen coins and the hopper device 112 above is used for 50 yen coins. Thus, 500 yen coins which are thrown into the vending machine and the money kind thereof is judged and reserved in hopper device 111). And, when the purchase button of 300 yen commodity of vending machine is pushed, electric motor 130 is positively turned and the 500 yen coin is discharged in passage 118. The 500 yen coin discharged from the hopper device 110 passes sensor 190 and falls naturally in passage 118. When the 500 yen coin passes sensor 190, the money kind thereof is judged, and solenoid S4 is operated by the 500 yen judgment signal. When solenoid S4 is operated, guide board G4 is projected into passage 118, and the falling 500 yen coin is taken into hopper device 14. On the other hand, the 300 yen commodity is disbursed from the vending machine by means of the signal processor such as CPU. At the same time, the exchange coin signal which means 500 yen minus 300 yen equals 200 yen is outputted to electric motor (not show) of hopper device 113. When this electric motor is driven, one 100 yen coin is discharged from the hopper device 113 to passage 119 One 100 yen coin discharged from the hopper device 113 passes the sensor (not shown) and falls naturally in passage 119. This sensor detects one 100 yen coin and transmits the detection signal to the signal processor. One 100 yen coin discharged in passage 119 falls naturally and is disbursed to the return entrance of vending machine as exchange money. On the other hand, the said electric motor is driven further and another 100 yen coin from the hopper device 113 is discharged in passage 119. As well as the above-mentioned, the said sensor detects the 100 yen coin of another piece and transmits the.detection signal to the signal processor. This signal processor confirms the completion of exchange money of said 200 yen and stops the electric motor of third hopper device 113. Therefore, as exchange money, two 100 yen coins of total will be disbursed at the return entrance of vending machine.

Figure 8:
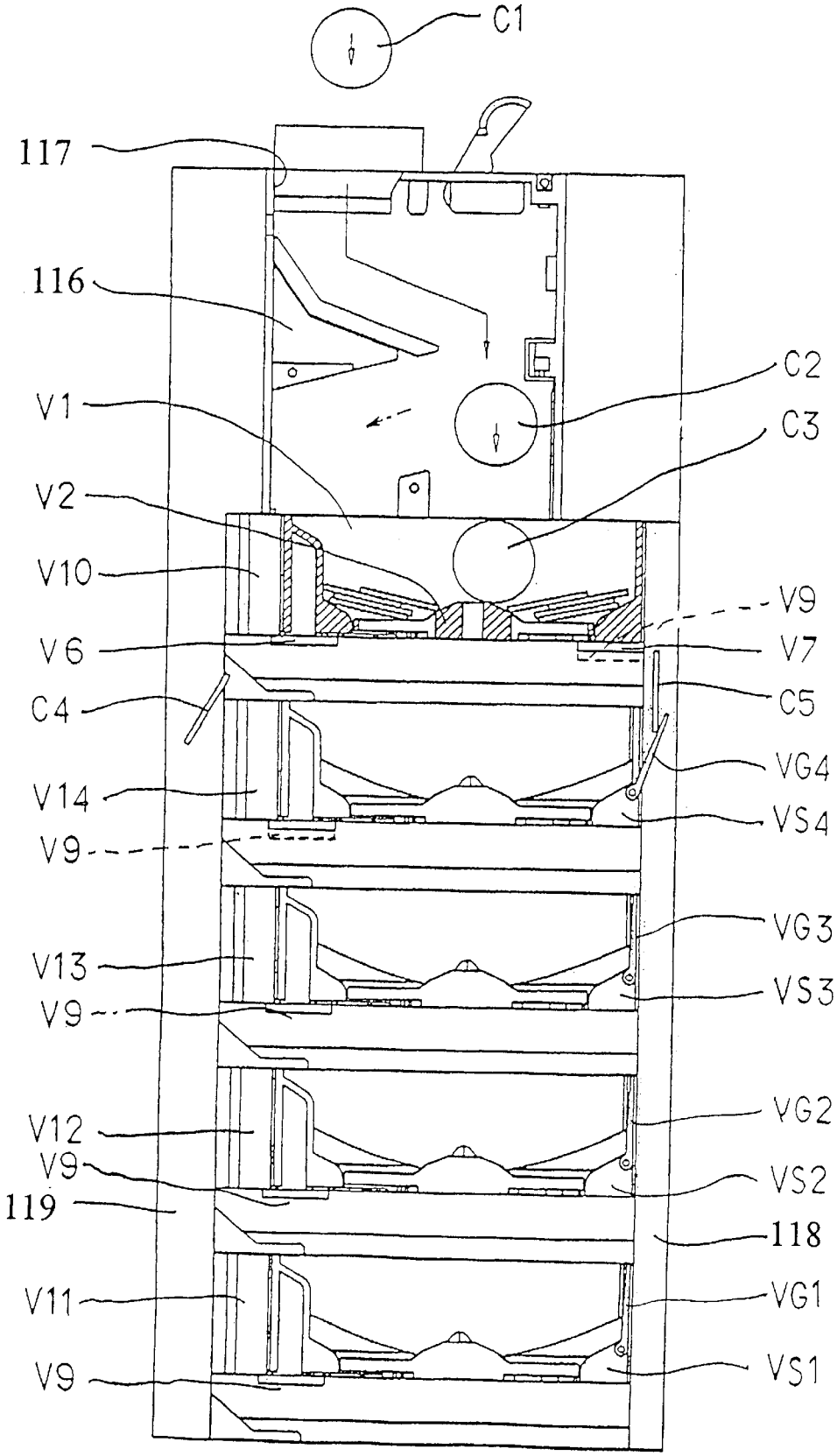
FIG. 8 is a partially sectional side view of the third embodiment of the invention.
Figure 9:
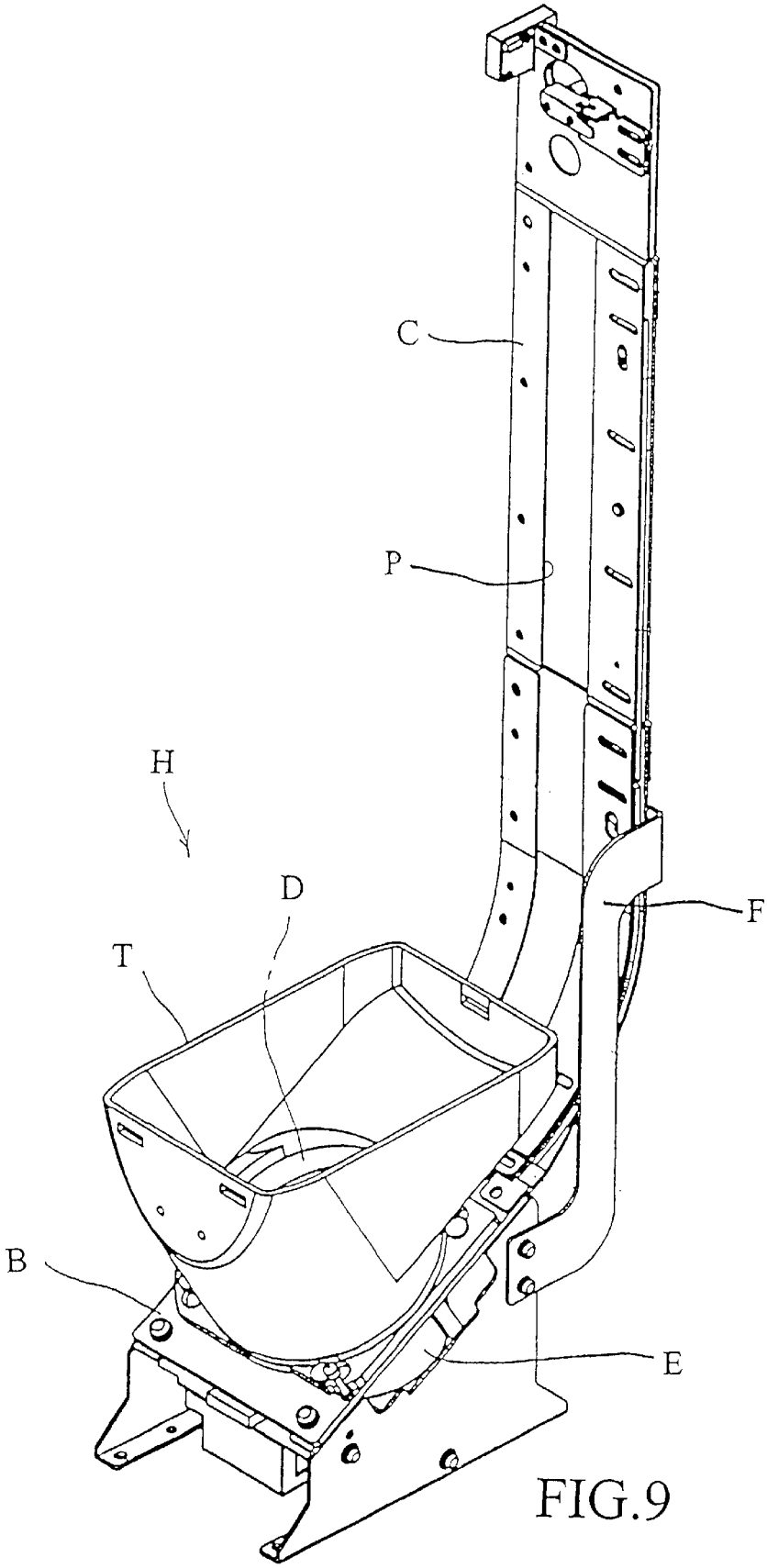
FIG. 9 is a perspective view of a known device.

A coin processor, which is the fourth example, is shown in FIG. 8 in the outline. The most top hopper device V10 is about the same as hopper device 110 of FIG. 7. The bottom position of tank V1 where coins are stored has a disk V2. This disk V2 can make positive and reverse rotations. Moreover, the discharge entrance V6 for cancellation is formed, and discharge entrance V7 for coin acceptance is formed on the opposite side. Sensor V9 for money kind detection is arranged at coin discharge entrance V7. When an electric motor (not shown) is reversely rotated, as for the hopper device V10, disk V2 is rotated counterclockwise, existing gears etc. As a result, the coin in tank V1 will be disbursed one by one from discharge entrance V6 by means of disk V2. Similarly, when electric motor is positively rotated, disk V2 is rotated clockwise. As a result, the coin in tank V1 will be disbursed one by one from the other discharge entrance V7 by means of disk V2. The money kind of disbursed coin C5 is judged electronically upon passing the sensor V9. The embodiment in FIG. 8 operates in a manner similar to that described for the embodiment of FIG. 7.

When coin C1 is deposited into the vending machine (not shown), the coin is inserted in the slot 117 of selector 116. As for coin C2 inserted in slot 117, the money kind thereof is distinguished with selector 116. Still, the coin (not shown) of which money kind is not distinguished is guided into passage 119 to be canceled. Coin C2 of which the money kind is distinguished with selector 116 is stored in hopper device V10. In another way, coin C3 of which the money kind is known is reserved temporarily in hopper device V10. When the return button (not shown) is pushed at this state, disk V2 is reversely rotated. Therefore, the coin in tank V1 is discharged into cancellation passage 119. At the above-mentioned time, that is, when coin C3 of which the money kind is known is reserved in hopper device V1, the commodity purchase button (not shown) is pushed. At this time, disk V2 is positively rotated and coin C3 is discharged into passage 118 for coin processing. Coin C5 discharged from hopper device V10 passes sensor V9 and falls naturally in passage 118. When coin C5 passes sensor V9, the money kind thereof is judged and the judgment signal is sent By this judgment signal, for instance, solenoid VS4 of rotation type (described later) is operated Four hopper devices V11–V14 are piled up under hopper device V10 in a manner as in the embodiment of FIG. 7. Each solenoid VS1–VS4 is built in each hopper device V11–V14 respectively. For instance, when solenoid VS4 is operated, guide board VG4 is rotated into passage 118. In this case, falling coin CS is taken into hopper device V14, by means of guide board VG4 in passage 118. For explanation in FIG. 8, the most upper hopper device V14 is used for a larger coin e.g., 500 yen coin. The hopper device V13 below is used for eg., a 100 yen coin. This, one 500 yen coin, which is thrown into the vending machine and of which money and is known, is reserved in hopper device V10. And, when the purchase button of 300 yen commodity of vending machine is pushed, disk V2 is positively rotated and the 500 yen coin is discharged in passage 118. The 500 yen coin C5 discharged from hopper device V10 passes sensor V9 and falls naturally in passage 118. When the 500 yen coin passes sensor V9, the money kind thereof is judged and solenoid VS4 is operated by the 500 yen signal. When solenoid VS4 is operated, the guide board VG4 is rotated in the passage 118. Thus, the falling 500 yen coin C5 is taken into hopper device V14 On the other hand, 300 yen commodity is disbursed from the vending machine by means of the signal processor such as CPU. At the same time, exchange money signal which means 500 yen minus 300 yen equal 200 yen is outputted to electric motor (not show). When this electric motor is driven, one 100 yen coin is discharged from hopper device V13 into passage 119. One discharged 100 yen coin passes the sensor V9 of hopper device V13 and falls naturally in passage 19. This sensor V9 detects one 100 yen cain and transmits the detection signal to the signal processor. One 100 yen coin discharged in passage 119 falls naturally and is disbursed at the return entrance of vending machine as exchange money. On the other hand, the electric motor is driven further, and another 100 yen coin is discharged from hopper device V13 into passage 119. As well as the above-mentioned, the sensor V9 detects another 100 yen coin and transmits the detection signal to the signal processor. This signal processor confirms the completion of exchange money of the 200 yen and stops the electric motor of third hopper device 113. As a result, two 100 yen coin of total will be disbursed at the return entrance of vending machine as exchange money.

As mentioned above, according to this invention, the coin thrown into the vending machine is temporarily reserved, and it is effective that the thrown-into coin can be returned as it is, by adding the simple composition. That is, this invention has the effect that there is no exchange of a pseudo coin for a true coin. The escrow function is added to the coin processor for vending machine. In other words, this invention has the effect that thrown-into coin is temporarily reserved, and the said coin can be received into the vending machine only when the commodity purchase button is pushed.

While specific embodiments of the invention have been shown and described in detail to illustrate the application of the principles of the invention, it will be understood that the invention may be embodied otherwise without departing from such principles.

What is claimed is:

1. A coin processor comprising at least:

a selector for distinguishing a kind of inserted coins, and for guiding an un-distinguished coin in a passage for return;

a hopper provided under the selector for reserving temporarily and loosely the coins which are distinguished by the selector;

a rotate-able disk provided at a bottom of the hopper for discharging the distinguished coins one by one;

a discharge port in the hopper for passing the distinguished coins into the passage when the disk is rotated; and a sensor for detecting a kind of money arranged at the discharge port;

a plurality of storage hoppers selectively connectable to said passage and selectively receivable of a coin from said temporary hopper depending on the type of coin detected by said sensor, each said storage hopper being holdable of coins as a group;

a discharge port in said each storage hopper and connected to said passage;

a rotatable disk in said each storage hopper and dischargeable of coins in respective said storage hoppers through respective said discharge ports to said passage;

a sensor arranged at each of said discharge ports of said storage hoppers and detectable of a type of coin passing through respective said discharge ports.

2. A coin processor comprising at least:

a selector for distinguishing a kind of inserted coins, and for guiding an un-distinguished coin in a first passage for return;

a tank for reserving temporarily and loosely the coins which are distinguished by the selector;

a rotate-able disk provided at a bottom of the tank for discharging the distinguished coins one by one;

a first discharge for passing the distinguished coins into the first passage when the disk is rotated counterclockwise;

a second discharge for passing the distinguished coins into a second passage when the disk is rotated clockwise; and a sensor for detecting a kind of money arranged at the second discharge.

3. A coin processor comprising;

a selector for receiving a coin and determining a coin type of the coin, said selector selectively processing the coin depending on the coin type;

a passage connected to said selector and receivable of a coin from said selector;

a temporary hopper connected to said selector and receivable of a plurality of coins from said selector, said temporary hopper being holdable of the coins as a group, said temporary hopper including a discharge port connected to said passage;

a rotatable disk in said temporary hopper and dischargeable of coins in said temporary hopper through said discharge port to said passage;

a sensor arranged at said discharge port of said temporary hopper and detectable of a type of coin passing through said discharge port.

4. A coin processor in accordance with claim 3, further comprising:

a plurality of storage hoppers selectively connectable to said passage and selectively receivable of a coin from said temporary hopper depending on the type of coin detected by said sensor, each said storage hopper being holdable of coins as a group.

5. A coin processor in accordance with claim 4, further comprising:

a discharge port in said each storage hopper and connected to said passage;

a rotatable disk in said each storage hopper and dischargeable of coins in respective said storage hoppers through respective said discharge ports to said passage;

a sensor arranged at each of said discharge ports of said storage hoppers and detectable of a type of coin passing through respective said discharge ports.

6. A coin processor in accordance with claim 4, wherein:

said plurality of storage hoppers are connectable to said passage by selectively moving said each storage hopper into and out of said passage.

7. A coin processor in accordance with claim 3, further comprising:

another passage connected to said selector, said selector detecting a category of a coin and selectively passing the coin to one of said passage and said another passage depending on the category;

another discharge port arranged in said temporary hopper, said rotatable disk selectively passing coins in said temporary hopper to one of said discharge port and said another discharge port.

8. A coin processor in accordance with claim 7, further comprising:

a plurality of storage hoppers selectively connectable to said passage and receivable of a coin from said temporary hopper depending on the type of coin detected by said sensor; each said storage hopper being holdable of coins as a group.

9. A coin processor in accordance with claim 8, further comprising:

a discharge port in each of said storage hoppers and connected to said passage;

a rotatable disk in each of said storage hoppers and dischargeable of coins in respective said storage hoppers through said discharge ports into said passage;

a sensor arranged at each of said discharge ports of said storage hoppers and de eatable of a type of coin passing through respective said discharge ports.

10. A coin processor in accordance with claim 4, wherein:

said plurality of storage hoppers are connectable to said passage by selectively moving a guide board into and out of said passage.

11. A coin processor in accordance with claim 3, wherein:

said temporary hopper holds the coins as a random interned singe group.

12. A coin processor in accordance with claim 4, wherein:

each of said storage hoppers holds the coins as a random intermixed single group.

13. A coin processor in accordance with claim 9, wherein:

each of said storage hoppers holds the coins as a random intermixed single group.

* * * * *